US007909300B2

(12) United States Patent
Kidder et al.

(10) Patent No.: US 7,909,300 B2
(45) Date of Patent: Mar. 22, 2011

(54) COMBUSTOR BRACKET ASSEMBLY

(75) Inventors: Kyle Kidder, Ferndale, MI (US); Patrick Benedict Melton, Horse Shoe, NC (US)

(73) Assignee: General Electric Company, Schenectady, NY (US)

( * ) Notice: Subject to any disclaimer, the term of this patent is extended or adjusted under 35 U.S.C. 154(b) by 541 days.

(21) Appl. No.: 11/874,710

(22) Filed: Oct. 18, 2007

(65) Prior Publication Data

US 2009/0101788 A1 Apr. 23, 2009

(51) Int. Cl.
*A47B 91/00* (2006.01)

(52) U.S. Cl. ..... 248/346.5; 248/676; 248/678; 248/346.03; 248/346.04; 60/796

(58) Field of Classification Search ..... 248/671, 248/674, 675, 676, 678, 174, 300, 346.03, 248/346.04, 346.5, 152; 60/796
See application file for complete search history.

(56) References Cited

U.S. PATENT DOCUMENTS 1,400,564 A * 12/1921 Metzger ..... 248/473
2,100,077 A * 11/1937 Harrison ..... 248/173
2,103,026 A * 12/1937 Van Valkenburg ..... 473/388
2,537,501 A * 1/1951 Woodward ..... 30/374
4,106,735 A * 8/1978 Partain et al. ..... 410/49
4,151,822 A * 5/1979 Miura et al. ..... 123/195 A
4,739,206 A * 4/1988 Sieber ..... 310/91
5,060,906 A * 10/1991 Gayle ..... 248/503
5,160,243 A * 11/1992 Herzner et al. ..... 416/220 R
5,240,375 A * 8/1993 Wayte ..... 416/219 R
5,265,412 A * 11/1993 Bagepalli et al. ..... 60/800
5,749,218 A * 5/1998 Cromer et al. ..... 60/796
6,059,384 A * 5/2000 Ho ..... 312/223.2
6,132,175 A * 10/2000 Cai et al. ..... 416/220 R
6,412,743 B1 * 7/2002 Fell ..... 248/441.1
6,581,785 B1 * 6/2003 Falkenstein ..... 211/24
6,869,051 B2 * 3/2005 Bishop ..... 248/71
6,904,756 B2 * 6/2005 Mack ..... 60/796
7,040,098 B2 * 5/2006 Lepretre et al. ..... 60/799
7,314,207 B2 * 1/2008 Jones ..... 248/676

* cited by examiner

*Primary Examiner* — Terrell Mckinnon
*Assistant Examiner* — Michael McDuffie
(74) *Attorney, Agent, or Firm* — Cantor Colburn LLP

(57) ABSTRACT

A bracket assembly for securing a transition segment to a combustion liner of a gas turbine engine includes at least one flange mounted to the transition segment. The at least one flange includes a channel that extends radially from the transition segment. The bracket assembly further includes a bracket fixedly mounted relative to the gas turbine engine. The bracket includes an elongated section having at least one end section that is received by the channel to establish an axial floating interface that secures the transition segment to the combustion liner.

11 Claims, 6 Drawing Sheets

COMBUSTOR BRACKET ASSEMBLY

BACKGROUND OF THE INVENTION

The present invention pertains to the art of gas turbine engines and, more particularly, to an assembly for securing a transition segment to a combustion liner in a gas turbine engine.

A gas turbine combustor includes a combustion liner that defines a combustion chamber. A transition segment extends between the combustion liner and a turbine first stage. A conventional assembly for securing a transition segment to a combustion liner includes a bullhorn. The bullhorn includes a plurality of bullhorn fingers. The bullhorn fingers extend axially away from the bullhorn and engage corresponding H-shaped guide blocks secured to the transition segment. The bullhorn fingers are disposed within the H-shaped block both below and above a cross sectional bar. With this arrangement, the transition segment is secured to the combustion liner through an axially floating interface. The floating interface allows the transition segment to expand axially and contract as a result of exposure to high temperature thermal conditions that exist in an operating turbine. Unfortunately, the floating interface places stress on the bullhorn fingers. Over time, the bullhorn lingers fail, and the gas turbine engine must be taken offline for repair.

BRIEF DESCRIPTION OF THE INVENTION

In accordance with one aspect of the invention, a bracket assembly for securing a transition segment to a combustion liner of a gas turbine engine is provided. The bracket assembly includes at least one flange mounted to the transition segment. The at least one flange includes a channel that extends radially from the transition segment. The bracket assembly further includes a bracket fixedly mounted relative to the gas turbine engine. The bracket includes an elongated section having at least one end section that is received by the channel to establish an axially floating interlace that secures the transition segment to the combustion liner.

In accordance with another aspect of the present invention, a bracket is provided. The bracket includes an elongated section having opposing ends. The bracket further includes first and second curved sections that extend from respective ones of the opposing ends of the elongated section. The bracket also includes first and second end sections that extend from end portions of respective ones of the first and second curved sections. Each of the first and second end sections is angled relative to the elongated section. The bracket is adapted to establish an axially floating interface that secures a transition segment or a gas turbine engine to a combustion liner.

At this point it should be appreciated that the present invention provides a robust attachment mechanism for securing a transition segment to a combustion liner it a gas turbine engine. The design of the bracket significantly improves High Cycle fatigue (HCF) life and reliability, as well as reduces maintenance costs associated with engine down time resulting from a bracket failure. Moreover, it has been found that a bracket constructed as described above is capable of withstanding loads approximately 35% higher than prior alt constructions. In any event, additional objects, features and advantages of various aspects of the present invention will become more readily apparent from the following detailed description when taken in conjunction with the drawings wherein like reference numerals refer to corresponding parts in the several views.

DETAILED DESCRIPTION OF THE INVENTION

Figure 1:
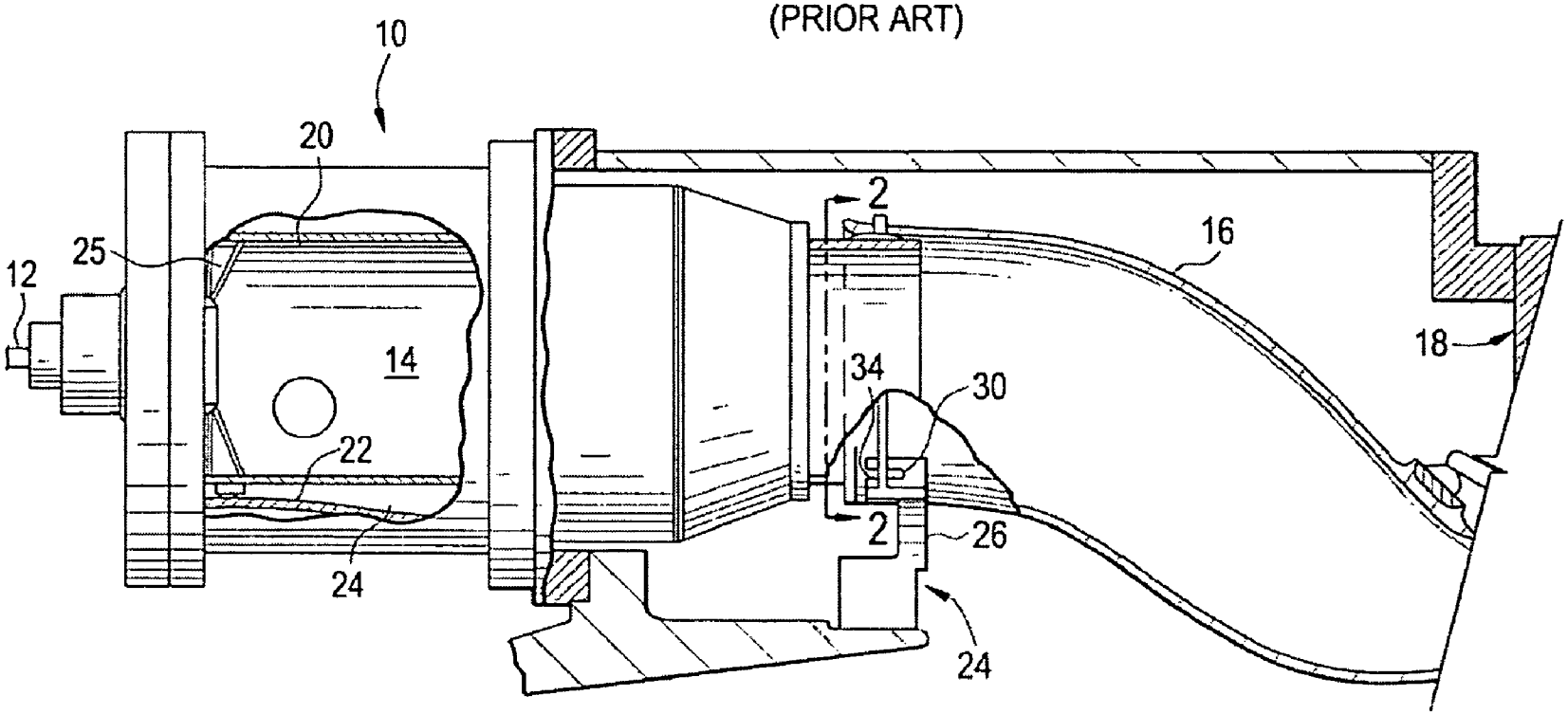
FIG. 1 (PRIOR ART)
FIG. 1 is a side elevational view illustrating a conventional gas turbine engine combustor, in accordance with prior art.

With initial reference engine to FIG. 1, a combustor assembly 10 of a multiple combustor gas turbine engine (not shown) includes a fuel nozzle 12 (some gas turbines employ multiple nozzles in each combustor), a combustion chamber 14 and a transition segment 16 that extends between combustion chamber 14 and a turbine first stage 18. Combustion chamber 14 is defined by a substantially cylindrical combustion liner 20 that, in turn, is surrounded by a substantially cylindrical flow sleeve 22. A radial space between flow sleeve 22 and liner 20 provides all airflow passage (not separately labeled) that allows compressor discharge air to be reverse flowed to an upstream or nozzle end 25 of liner 20 and then introduced into combustion chamber 14 for mixing with fuel.

Figure 2:
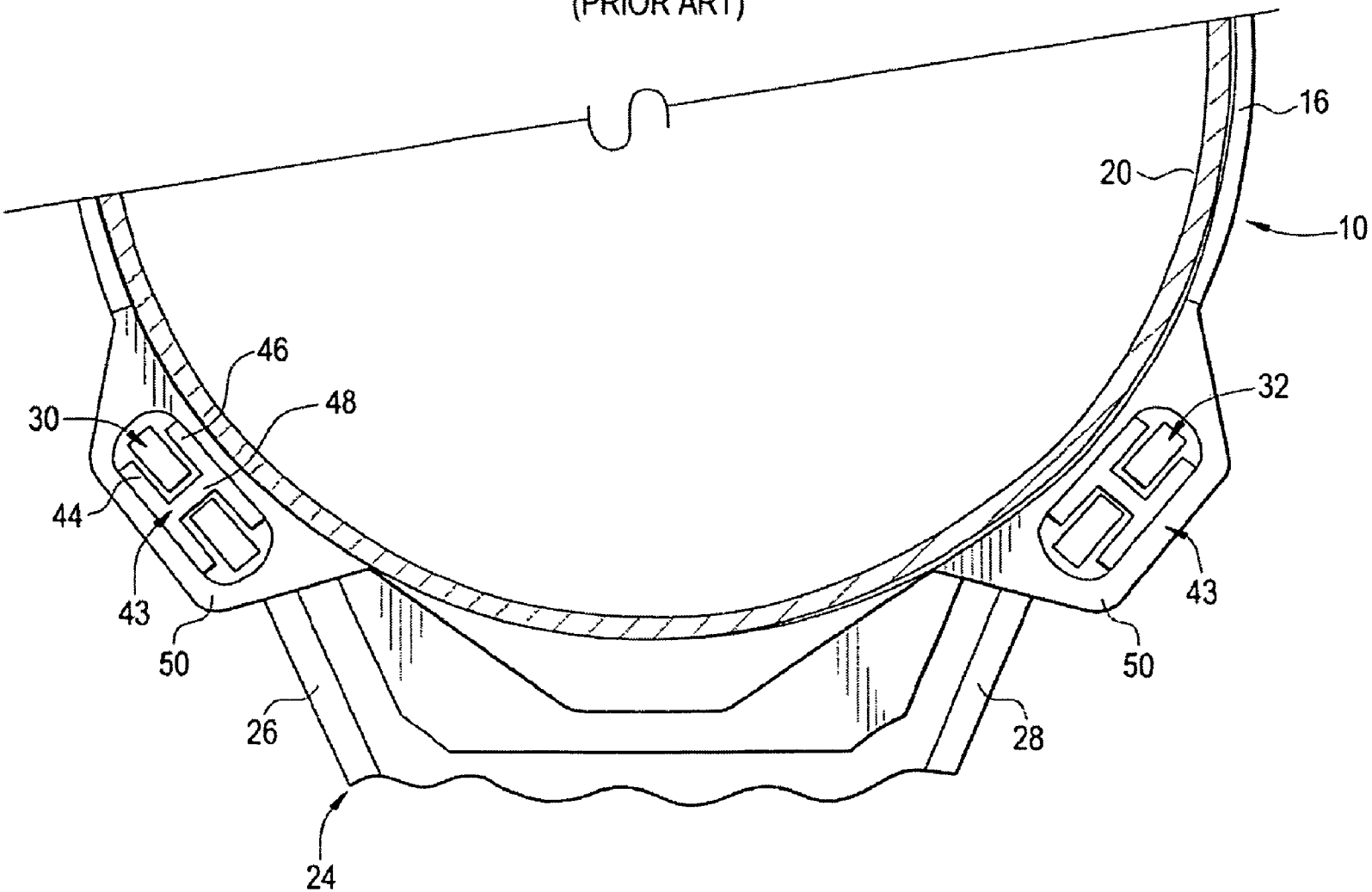
FIG. 2 (PRIOR ART)
FIG. 2 is a partial cross-sectional view of the gas turbine engine combustor of FIG. 1 taken along the line 2-2.
Figure 3:
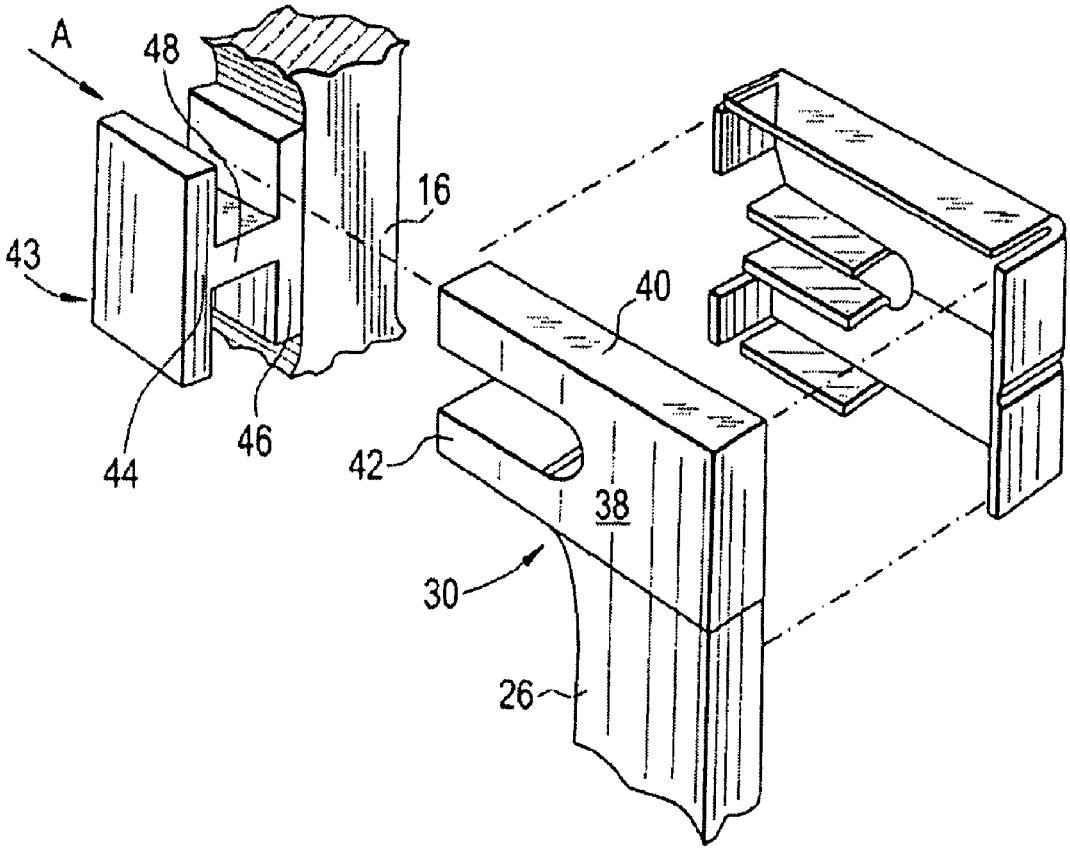
FIG. 3 (PRIOR ART)
FIG. 3 is an exploded view illustrating a guide block and cooperating guide fingers in accordance with the prior art.

Referring to FIGS. 2 and 3, transition segment 16 is secured to combustion liner 20 through an axially floating interface i.e. transition segment 16 is allowed to expand axially due to exposure to high temperature thermal conditions associated with an operating gas turbine. A forward support 24 of combustor 10 is defined by a pair of arms 26 and 28 that extend outwardly and upwardly to either side of transition segment 16. Each arm 26, 28 of forward support 24 includes a corresponding axially extending guide finger element 30, 32. As each guide finger element 30, 32, is identical, a detailed description will follow with reference to guide finger element 30 with an understanding that guide finger element 32 is identically constructed. Guide finger element 30 is constructed of steel and, as shown in FIG. 3, includes a solid body portion 38 and a pair of axially extending, laterally spaced, fingers 40 and 42. Fingers 40 and 42 extend axially outward away from solid body portion 38. In use, as shown in FIG. 1, fingers 40 and 42 extend axially, in an upstream direction, i.e., towards and parallel to a longitudinal axis of and combustor 10. Forward support 24, together with arms 26 and 28 and guide finger elements 30 and 32 are collectively known as a bullhorn. Fingers 40, 42 are commonly referred to as bullhorn fingers. Bullhorn fingers 40 and 42 of guide finger element 30 slidably engage an H-shaped guide block 43. As shown, H-shaped guide block 43 includes parallel elongated portions 44 and 46 interconnected by a cross portion 48. Elongated portions 44 and 46 are welded within a flange 50 of transition segment 16, as shown in FIG. 2, relatively closely adjacent the upstream or combustor end thereof. H-shaped guide block 43 is positioned such that elongated portions 44 and 46 are tangential to transition segment 16, as shown in FIG. 2. At this point it should be understood that a plurality of bullhorns and cooperating H-shaped blocks provide an interface that secures transition segment 16 to combustion liner 20, as discussed above.

Figure 4:
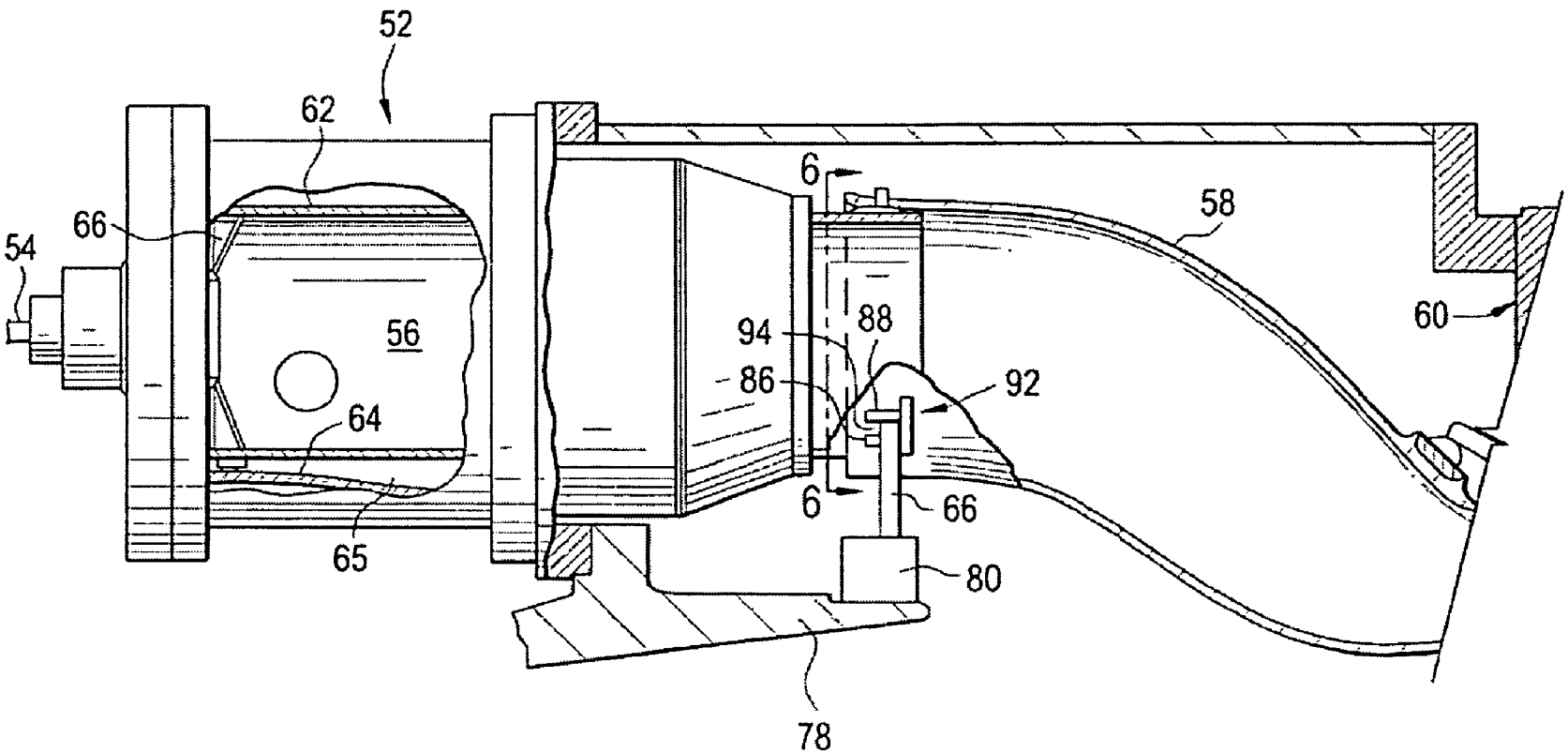
FIG. 4 is a side elevational view illustrating a gas turbine engine combustor including a combustor bracket assembly in accordance with one aspect of the present invention.
Figure 5:
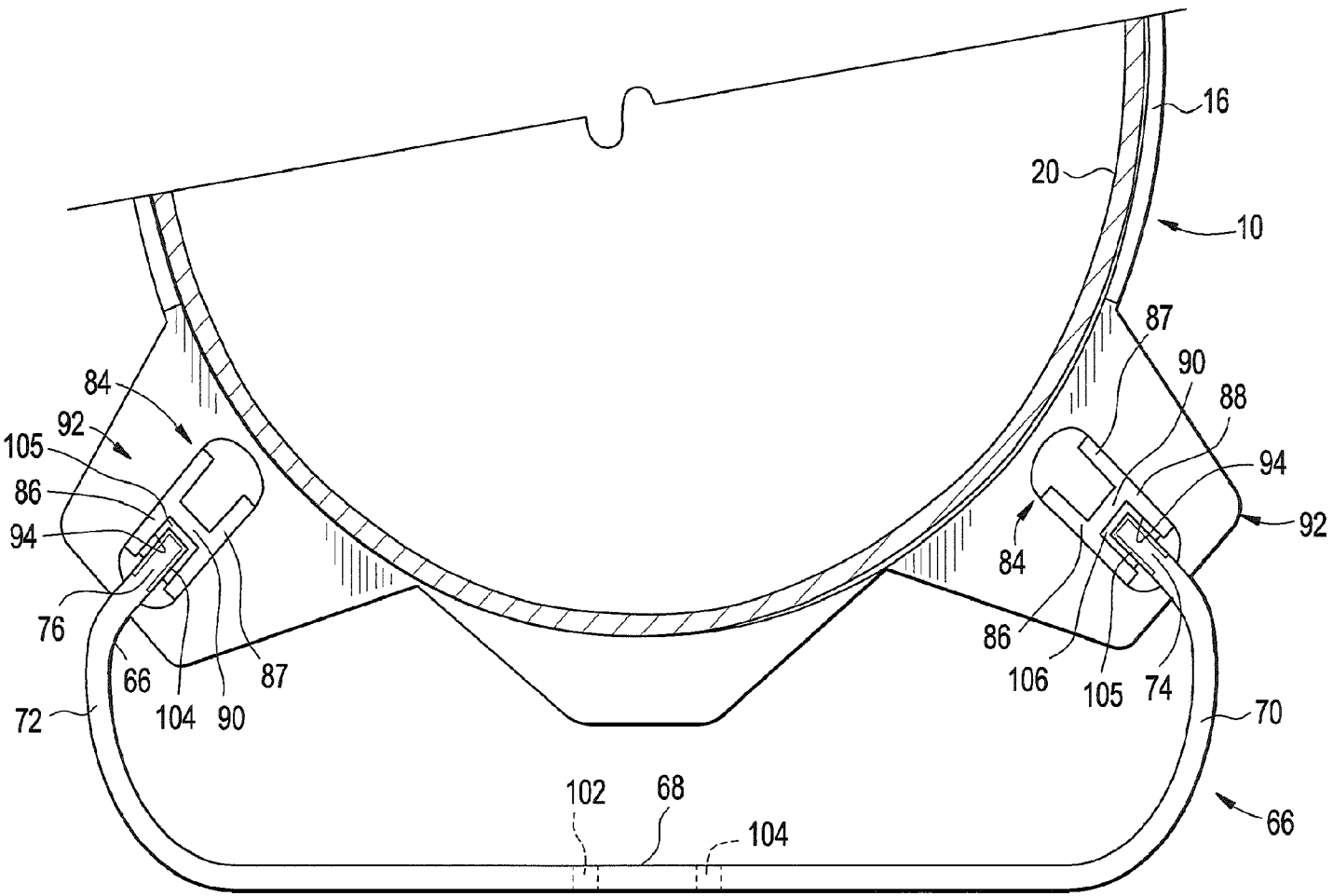
FIG. 5 is a partial cross-sectional view of the gas turbine engine combustor of FIG. 4 taken along the line 6-6.

Reference will now be made to FIGS. 4-5 in describing an exemplary embodiment of the invention. A combustor assembly 52 of a multiple combustor gas turbine engine includes a fuel nozzle 54 (some gas turbines employ multiple nozzles in each combustor), a combustion chamber 56 and a transition segment 58. In a manner similar to that described above, transition segment 58 extends between combustion chamber 56 and a turbine first stage 60. Combustion chamber 56 is defined by a substantially cylindrical combustion liner 62 that, in turn, is surrounded by a substantially cylindrical flow sleeve 64. A radial space 65 between flow sleeve 64 and liner 62 provides an airflow passage (not separately labeled) that allows compressor discharge air to be reverse flowed to an upstream or nozzle end 66 of liner 62 and introduced into combustion chamber 56 to mix with fuel.

As shown, transition segment 58 is secured to combustion liner 62 through an axially floating interface, i.e., transition segment 58 is allowed to expand and contract axially as a result of exposure to high temperature thermal conditions associated with an operating gas turbine engine. Combustor assembly 52 includes a flange 78 having mounted thereto a support 80 that extends toward transition segment 58. Support 80 includes a pair of mounting holes (not shown) extending therethrough, for securing support 80 to flange 78. An H-shaped guide block 84, having a pair of generally parallel elongated portions 86 and 88 interconnected by a cross portion 90, is welded within a flange 92 provided on transition segment 58. Flange 92 is positioned relatively closely adjacent to an upstream or combustor end (not separately labeled) of transition segment 58. H-shaped guide block 84 is positioned such that elongated portions 86 and 88 extend radially outward from transition segment 58. In this manner, elongated portions 86 and 88, define at least one channel 94, the purpose of which will become more fully evident below. At this point it should be understood that while only two H-shaped guide blocks 84 and associated flanges 92 are illustrated in FIG. 5, transition segment 58 is provided with multiple H-shaped guide blocks 84 and corresponding flanges 92 not shown in the figures for sake of clarity. In any event, a bracket 66 secures transition segment 58 to support 80 and provides and axially floating interface as will be discussed more fully below.

Figure 6:
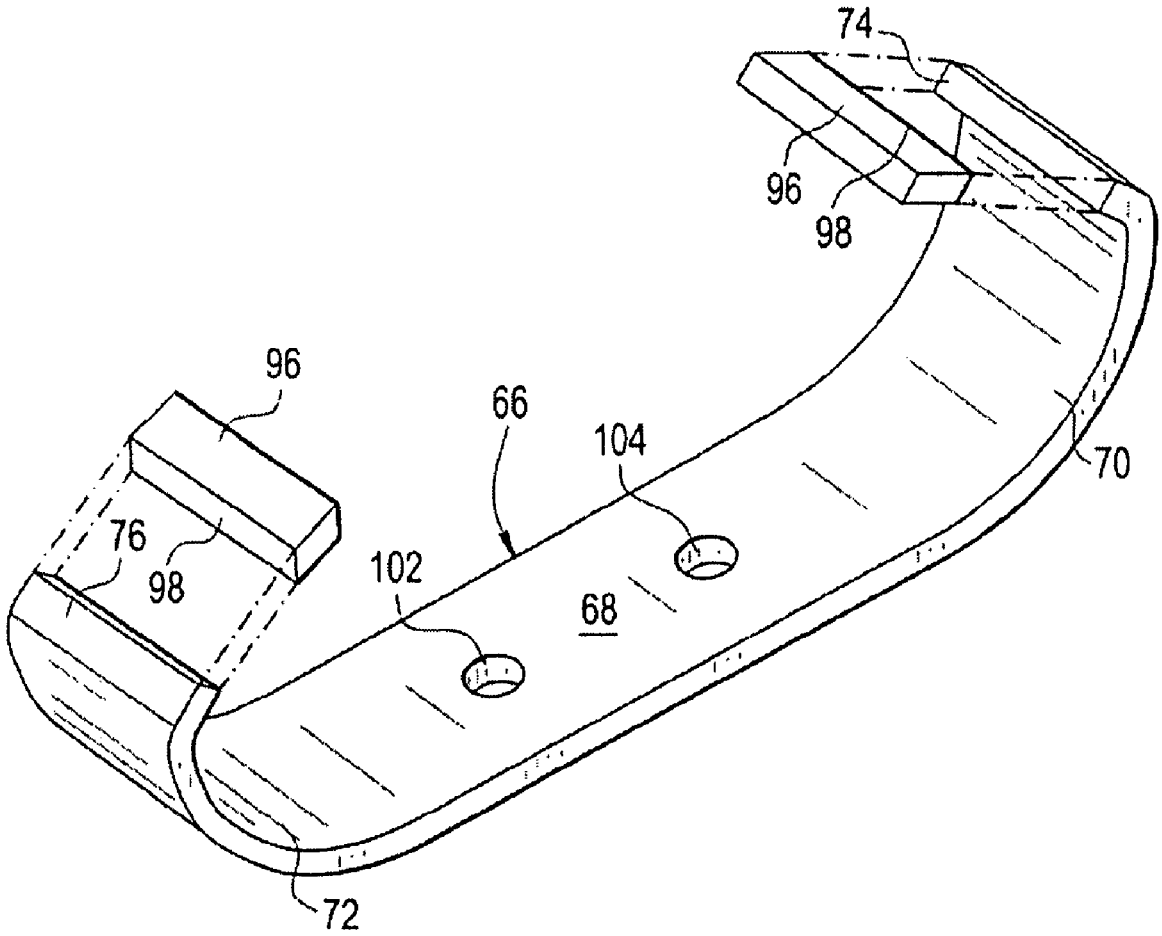
FIG. 6 is a perspective view of a bracket of the combustor bracket assembly of FIG. 5.

As best shown in FIG. 6, bracket 66 is formed in a generally elongated U-shape, defined by a central elongated section 68 having opposing ends (not separately labeled). Bracket 66 further includes first and second curved sections 70 and 72 that extend from respective ones of the opposing ends of elongated section 68 and terminate at inwardly extending end sections 74 and 76 respectively. End sections 74 and 76 include a width and length sufficient for being securely positioned within channels 94 of corresponding H-shaped blocks 84. Bracket 66, in accordance with one aspect of the invention, is constructed from a single steel plate that is bent to form all previous discussed sections. In accordance with one aspect of the invention, bracket 66 is formed from 304 stainless steel, however, it should be understood that various other materials can also be employed. In any event, each curved section 70, 72 includes an upward curve having a gradual slope initiating at a respective one of the opposing ends of elongated section 68 and which continue to a steeper slope prior to terminating at end sections 74 and 76 respectively. As shown, end sections 74 and 76 are bent upwardly and inwardly relative to elongated section 68.

Bracket 66 is provided with a pair of mounting holes 102 and 104 arranged equidistant from a center portion (not separately labeled) of elongated section 68. More specifically, mounting holes 102 and 104 on bracket 66 are aligned with corresponding openings (not shown) provided on support 80. In this manner, mechanical fasteners (not shown) are passed through mounting holes 102 and 104 and engage with the openings (not shown) provided on support 80. Various types of mechanical fasteners such as bolts, threaded rods and the like can be employed to secure bracket 66 to support 80. In any event, bracket 66 is secured to support 80 with end sections 74 and 76 being received by corresponding channels 94 in respective H-Shaped blocks 84. With this arrangement, bracket 66 serves to limit movement of transition segment 58 in a direction toward turbine first stage 60 while still allowing transition segment 58 to expand and/or contract axially as a result of exposure to high temperature thermal conditions of an operating gas turbine engine.

Improved wear characteristics are provided at an interface between bracket 66 and a cooperating H-shaped block 84 by utilizing a harder, more wear resistant Cobalt-based alloy. That is, in accordance with one aspect of the invention, H-shaped block 84 is formed from an alloy containing between approximately 28.5 and 30.5% Chromium and about 52% Cobalt. More preferably, H-Shaped block 84 is formed from an alloy having a composition of 10.5% wt Nickel, 2.0% wt Iron, 29.5% wt Chromium, 7% wt Tungsten, 1% wt Silicone, 1% wt Manganese, 0.25% wt Carbon with the balance being Cobalt such as FSX-414.

In accordance with another aspect of the invention, wear characteristics are further improved through the use of a wear cover 96 provided on each end section 74 and 76 of bracket 66. As shown in FIG. 6, wear cover 96 is formed from sheet material configured in a generally rectangular shape and provided with an opening 98. In this manner, opening 98 receives, for example, end section 74. Wear cover 96 is preferably constructed of a high temperature wear resistant Cobalt-based alloy. Preferably, wear cover 96 is formed from an alloy containing approximately 0.05/0.15% wt. Carbon, 1.00/2.00% wt Manganese, 0.040% wt Silicone, 0.030% wt Phosphorus, 0.3% wt Sulfur, 19.00/21.00% wt Chromium, 9.00/11.00% wt Nickel, 14.00/16.00% wt Tungsten and 3.00% wt Iron with the balance being Cobalt such as, for example, L-605. The use of an alloy having a high percentage by weight of Cobalt provides increased wear resistance for otherwise relatively soft end sections 74 and 76. The combination of FSX-414 and L-605 has advantageously been found to establish a resilient interface between H-shaped block 84 and bracket 66. Moreover, with the above described materials for the bracket 66 and H-shaped block 84, wear patterns have been found to develop on the softer, e.g., L-605 material that is more easily replaceable/repairable and less costly as compared to transition segment 58 and associated H-shaped blocks 84.

In accordance with another aspect of the invention, wear characteristics are improved through the use of a first wear cover, in the form of a wear resistant coating 105 applied to respective ones of end sections 74 and 76 of bracket 66, and a second wear cover in the form of a wear resistant coating 106 applied to channel 94 of H-shaped block 84 such as illustrated in FIG. 5. Wear resistant coatings 105 and 106 are formed from a cobalt-based alloy containing approximately 1.1% wt Carbon, 66.9% wt Cobalt, 28% wt Chromium, and 4% wt tungsten such as, for example, Stellite-6. Stellite-6 can be readily applied to both end sections 74, 76, and channel 94 to provide an easily repairable and maintainable wear resistant interface.

In an alternative arrangement, bracket 66 may be formed entirely of a high temperature, wear resistant alloy such as, for example, the L-605 alloy described above. It will also be appreciated that other wear resistant alloys having similar characteristics may also be used in accordance with the invention. In any event, bracket 66 significantly improves High Cycle fatigue (HCF) life and reliability, as well as reduces maintenance costs associated with engine down time resulting from a bracket failure. Moreover, it has been found that a bracket constructed as described above is capable of withstanding loads approximately 35% higher than prior art constructions.

While preferred embodiments have been shown and described, various modifications and substitutions may be made thereto without departing from the scope and scope of the invention. For example, the particular material used to form the bracket can vary without departing from the scope of the present invention. In addition, it should be understood that the H-shaped blocks can be formed from various materials having similar characteristics to FSX-414, including cobalt and non-cobalt based alloys, the wear covers can also be formed from various materials having wear characteristics similar to L-605 including both cobalt and non-cobalt based alloys, and a variety of materials, having attributes similar to Stellite-6, can be used to form the wear coatings. It should be readily appreciated that the above described materials should not be considered to represent an exhaustive list of acceptable materials for the various components and component portions of the present invention. In general, the invention is only intended to be limited by the scope of the following claims.

The invention claimed is:

1. A bracket assembly for securing a transition segment to a combustion liner of a gas turbine engine, the bracket assembly comprising:

at least one flange mounted to the transition segment, said at least one flange including a channel having first and second elongated portions extending radially from the transition segment; and a bracket fixedly mounted relative to the gas turbine engine, the bracket including an elongated section having at least one end section received by the channel to establish an axially floating interface securing the transition segment to the combustion liner.

2. The bracket assembly according to claim 1, wherein the at least one flange includes first and second flanges having first and second channels respectively, and the at least one end section includes first and second end sections extending into corresponding ones of the first and second channels.

3. The bracket assembly of claim 2, wherein the bracket further includes first and second curved sections extending between the elongated section and respective ones of the first and second end sections.

4. The bracket assembly of claim 1, further comprising: at least one wear cover disposed on the at least one end section of the bracket, the wear cover being formed from a wear resistant alloy.

5. The bracket assembly according to claim 4, wherein the at least one wear cover includes first and second wear resistant coatings, the first wear resistant coating being applied to the at least one end section and the second wear coating being applied to the at least one channel.

6. The bracket assembly according to claim 4, wherein the wear resistant alloy contains cobalt.

7. The bracket assembly according to claim 4, wherein the wear resistant alloy is a cobalt-based alloy including about 20% Chromium and about 53% Cobalt.

8. The bracket assembly of claim 2, further comprising: an H-shaped block mounted in the at least one flange, said H-shaped block including first and second generally parallel elongated portions interconnected by a cross portion that define the channel.

9. The bracket assembly according to claim 8, wherein the H-shaped block is formed from a wear resistant cobalt alloy.

10. The bracket assembly of claim 1, wherein the bracket is formed from steel.

11. The bracket assembly according to claim 10, wherein the bracket is formed from 304 stainless steel.

* * * * *